US005694135A

United States Patent [19]

Dikun et al.

[11] Patent Number: 5,694,135

[45] Date of Patent: Dec. 2, 1997

[54] MOLDED PATCH ANTENNA HAVING AN EMBEDDED CONNECTOR AND METHOD THEREFOR

[75] Inventors: Raymond Dikun, Boynton Beach, Fla.; Dennis Burrell, Bedford, Tex.; David M. Dickirson, Boca Raton, Fla.

[73] Assignee: Motorola, Inc., Schaumburg, Ill.

[21] Appl. No.: 573,975

[22] Filed: Dec. 18, 1995

[51] Int. Cl.[6] ..... H01Q 1/50; H01Q 1/38

[52] U.S. Cl. ..... 343/700 MS; 343/906

[58] Field of Search ..... 343/700 MS, 904, 343/906, 905, 702, 829, 830, 846, 848; H01Q 1/50, 1/38

[56] References Cited

U.S. PATENT DOCUMENTS 5,438,697 8/1995 Fowler et al. ..... 343/700 MS
5,475,394 12/1995 Kohls et al. ..... 343/700 MS

OTHER PUBLICATIONS

Motorola Meeting, Aug. 23, 1995, Antanna & Cable Division, M/A-COM-Inc.

*Primary Examiner*—Hoanganh T. Le
*Attorney, Agent, or Firm*—Keith A. Chanroo

[57] ABSTRACT

An antenna (100) has a connector (200) having a ground lead (102) and a signal lead (114). A dielectric (112) captures and embeds the connector (200) forming a connector substrate assembly (120) having a first side (122) and a second opposite side (124). A first conductive material (104) is affixed to the first side (122) of the connector substrate assembly (120) and coupling to the ground lead (102) and a second conductive material (110) is affixed to the second opposite side (124) of the connector substrate assembly (112) coupling the signal lead (114).

15 Claims, 5 Drawing Sheets

100

MOLDED PATCH ANTENNA HAVING AN EMBEDDED CONNECTOR AND METHOD THEREFOR

FIELD OF THE INVENTION

This invention relates in general to antennas, and more particularly to a molded patch antenna having an embedded connector and method therefor.

BACKGROUND OF THE INVENTION

Antennas for communication devices, especially portable communications receivers, such as selective call receivers, have generally been restricted to electromagnetic loop antennas that optimize signal reception when the receivers are worn on the body. While loop antennas have performed satisfactorily for many years, the newer generations of personal portable communication devices are becoming ever smaller and their uses are no longer limited to use on the body.

The size of the communication devices has imposed strict space demands on the antennas being utilized in such communication devices. To compensate for the decrease in available space, a patch antenna is used in portable communication devices. The patch antenna is advantageous because of its generally low profile. Such patch antennas typically include (a) a thin flat metallic region typically called the radiator; (b) a dielectric substrate; (c) a ground plane, which is usually much larger than the radiator; and (d) a feed which supplies or receives the radio frequency (RF) power.

Reducing the size of the antenna to fit within the strict space allocation of portable communication devices is not the end of the problem because once the antenna has been designed and tested, the antenna must be connected to the receiver circuitry. Generally, such connections include soldering, for example, a co-axial cable connection thereto which increases the size allocation. Therefore, what is needed, inter alia, is an antenna connection that connects the antenna and the receiver circuitry without increasing the size of the antenna to obtain the best antenna performance in a portable communication device.

DESCRIPTION OF A PREFERRED EMBODIMENT

Figure 1:
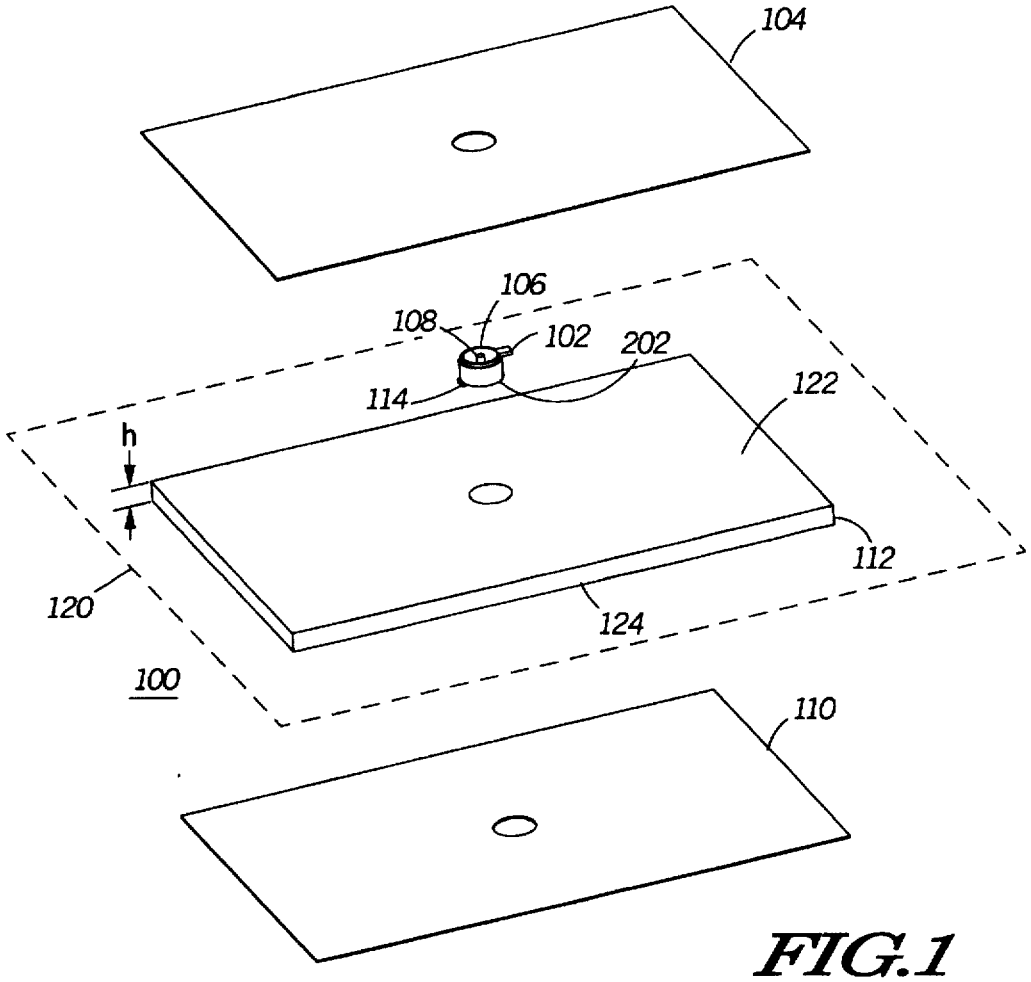
FIG. 1 is a perspective view of an exploded patch antenna and an embedded connector in accordance with a preferred embodiment of the present invention.

FIG. 1 is a perspective view of an exploded molded patch antenna and an embedded connector in accordance with a preferred embodiment of the present invention. The exploded molded patch antenna and embedded connector 100, in accordance with one embodiment of the invention as shown generally in FIG. 1, includes a ground lead (or terminal) 102 which is coupled to an outer circumference forming a circular housing 106. The ground lead 102 is electrically coupled to a conductive material 104 preferably comprising copper, for example copper foil. A signal connector 108 is terminated as a signal (terminal) lead 114. A second conductive material 110 is affixed to the signal lead 114, the second conductive material 110 preferably comprises copper, for example copper foil. However, before the first and second conductive materials 104 and 110 are coupled to the ground lead 102 and the signal lead 114, a dielectric substrate 112 of thickness h which, for example, formed from TMM-10 (Temperature stable Microwave Material), manufactured by Rogers Corporation of Chandler, Ariz., is poured or injected into a mold to secure and electrically isolate the ground lead 102 and signal terminal or lead 114. TMM-10 is a temperature stable microwave laminate that consists of a ceramic filled thermoset polymer and General Electric (GE) Ultem resin which is a polyethermide material that is 30% glass-filled.

It is preferred that the isolation between the ground lead 102 and the signal lead 114 be of a predefined or predetermined impedance, for example fifty ohms (50 Ω). It is appreciated that one skilled in the art knows how to obtain a predetermined impedance. Once the dielectric 112 is injected in the mold and cooled, it hardens and the ground lead 102, the signal lead 114 and the dielectric material 112 form a connector substrate assembly 120. The connector substrate assembly 120 is then removed from the mold, and the first conductive material 104 is affixed to a first side 122 of the connector substrate assembly 120 coupling with the ground lead 102. A second conductive material 110 is also affixed to a second opposite side 124 of the connector substrate assembly 120 coupling with the signal lead 114 to form the molded patch antenna.

Figure 3:
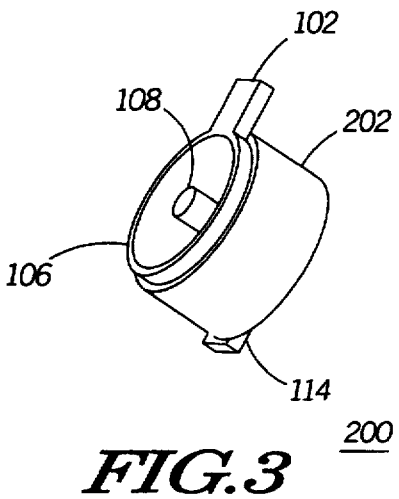
FIG. 3 is a perspective view of the assembled connector according to FIG. 1.
Figure 2:
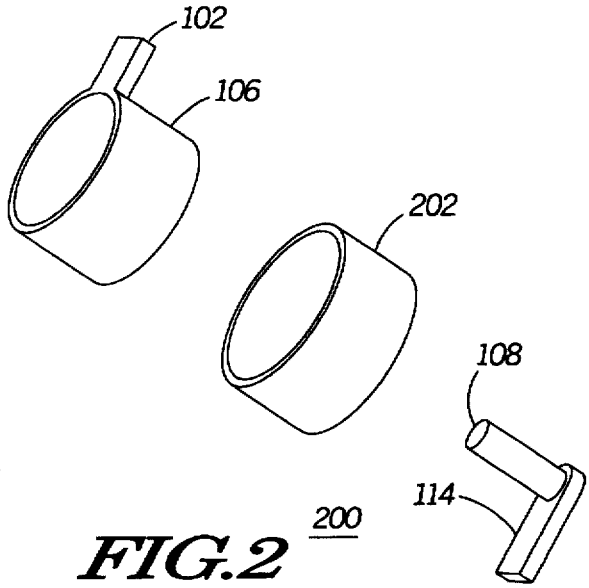
FIG. 2 is an exploded perspective view of the connector according to FIG. 1.

FIG. 2 illustrates an exploded perspective view of connector according to FIG. 1. The connector 200 comprises the ground lead 102 and the signal connector 108. The ground lead 102 is coupled to a circular housing 106 and the signal connector 108 is terminated into the signal lead 114. The ground lead 102 and the signal lead 114 are isolated by a circular insulative spacer 202 which also insulates the circular housing 106 and the signal connector 108. FIG. 3 illustrates the assembled connector 200 wherein the signal connector 108 is secured within the circular housing 106 and the ground lead 102 is also isolated therefrom by the insulative spacer 202. The assembled connector 200 mates with preferably a co-axial cable (not shown) via its signal connector 108 which connects the center lead of the co-axial cable and the circular housing 106 which is connected to the ground lead 102 as shown. Therefore, according to the preferred embodiment of the present invention, the connector 200 is a co-axial cable connector.

Figure 4:
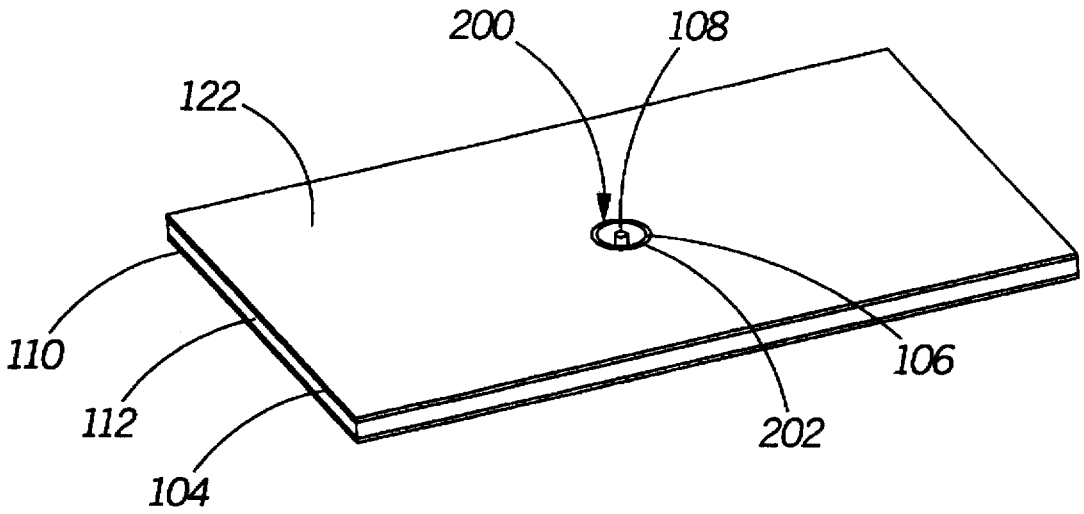
FIG. 4 is the assembled perspective view of the patch antenna and embedded connector in accordance with the preferred embodiment of the present invention.

Referring to FIG. 4, is a perspective view of the assembled patch antenna and embedded connector as illustrated according to FIG. 1. As shown, the first conductive material 104 is affixed to the first side 122 and the second conductive material 110 is affixed to the second opposite side 124. It is understood that the conductive material can be any other types of conductive materials known to those skilled in the art. When the conductive materials 104, 110 are affixed to the connector substrate assembly 120, the first conductive material 104 is electrically coupled to the ground lead 102 and the second conductive material is affixed to the signal lead 114.

In this way, a molded patch antenna is provided with co-axial connector integrated in the substrate and electrically coupled to the ground and the signal leads. Accordingly, the need for soldering the connector or a conductive interface to the antenna is eliminated thereby greatly reducing the opportunity for defects. Additionally, because the patch antenna and the connector can be assembled via a manufacturing process, the cost for manufacturing the patch antenna and embedded connector 100 is greatly reduced.

Figure 5:
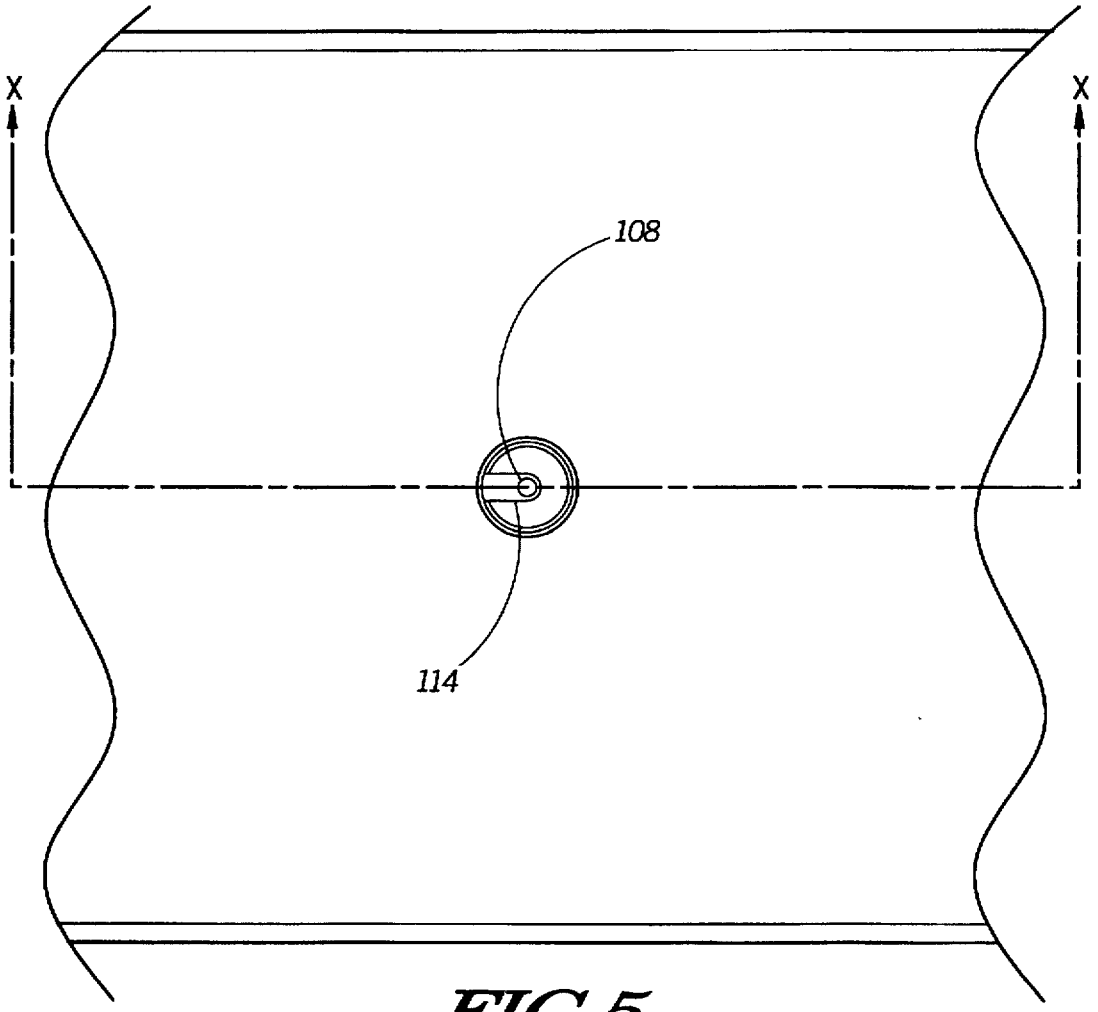
FIG. 5 is a top plan view of the patch antenna and connector according the FIG. 4.
Figure 6:
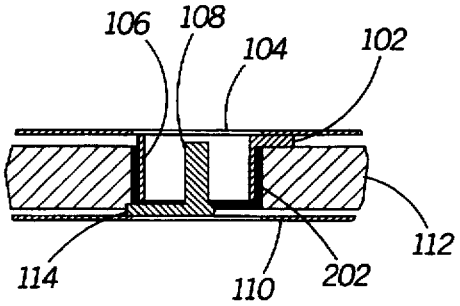
FIG. 6 is a magnified cross-sectional side view of the antenna according the FIG. 5.

FIG. 5 illustrates a top plan view of the antenna (molded patch antenna) and embedded connector while FIG. 6 illustrates a cross-sectional side view X—X according to FIG. 5. According to FIG. 5, the first side 122 is shown with the circular embedded connector 200 illustrating the signal connector 108 and the circular housing 106 with the first conductive material 104. FIG. 6 shows first and second conductive materials 104 and 110 electrically coupled to the ground lead 102 and the signal lead 114 respectively. The circular insulative spacer 202 electrically insulates the circular housing 106 and the signal connector 108 and, in conjunction with the molded substrate 112, produces the predetermined impedance.

Figure 7:
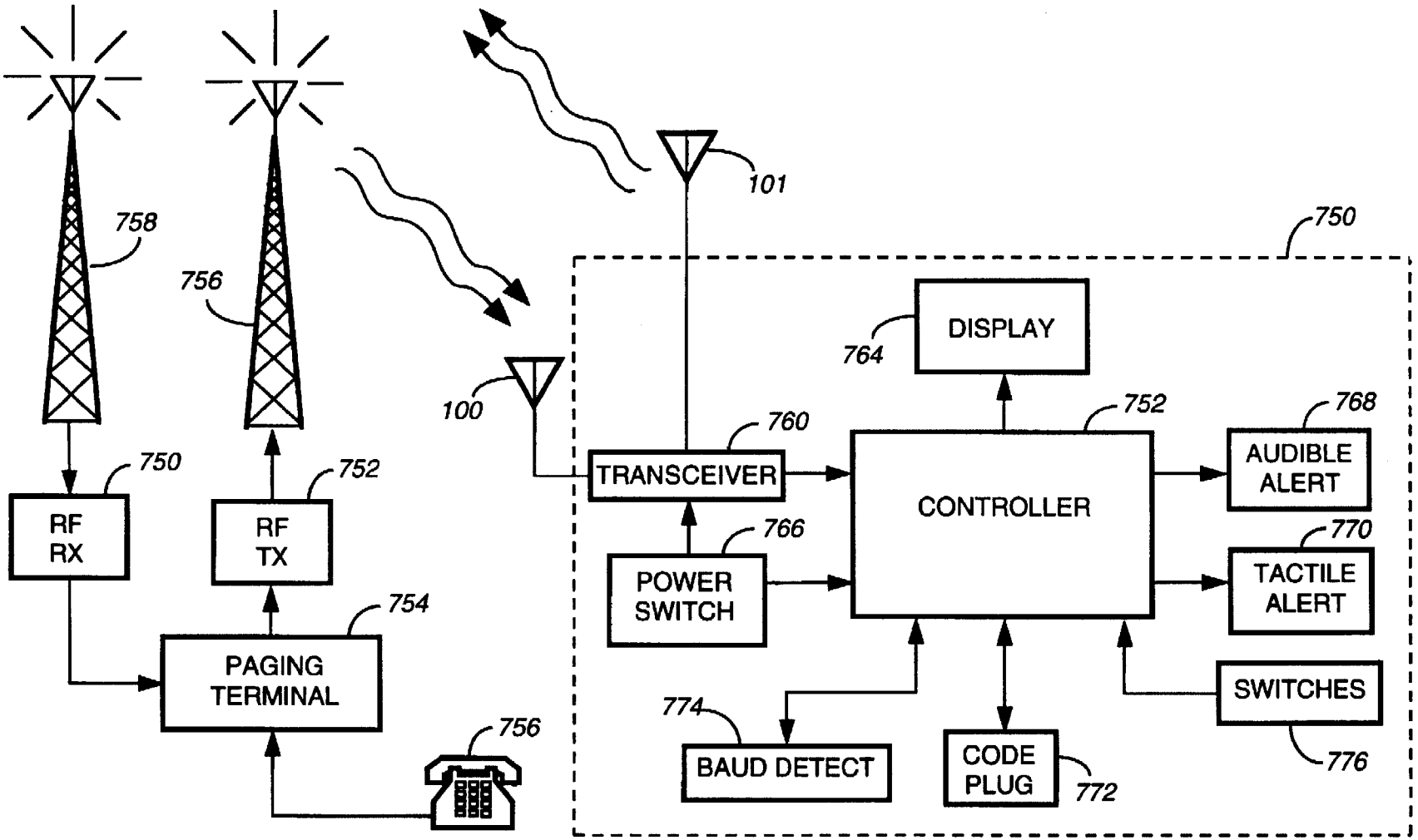
FIG. 7 is an electrical block diagram of a selective call system including a selective call receiver which incorporates the patch antenna of FIG. 4.

FIG. 7 is an electrical block diagram of a selective call system 700 illustrating a portable communication device, for example a selective call transceiver (or receiver) 750, which uses the patch antenna and embedded connector of FIG. 5. The selective call transmitter 752 is coupled to an input device, for example, a telephone 756 for inputting messages or initiating selective call messages via a selective call terminal 754. The selective call terminal 754 generates, e.g., selective call messages to be transmitted to respective selective call transceivers 750. The selective call controller 754 is coupled to the radio frequency transmitter for transmission of the selective call messages or other messages via a transmission antenna 756. Receiving, processing and transmitting selective call messages is known to one of ordinary skill in the art.

The transmissions are received by a selective call receiver 750 which includes transceiver 760, controller 762, display 764, power switch 766, audible alert 768, tactile alert 770, code plug 772, and baud detector 774. The electronic components forming these elements are represented by elements which, for example, constitute integrated circuits, resistors, capacitors, and other electronic components.

The selective call transceiver 750 further comprises a first patch antenna system antenna 100 for intercepting transmitted radio frequency (RF) signals which are coupled to the input of the receiver portion of transceiver 760. The RF signals comprise selective call (paging) message signals which provide, for example, a receiver address and an associated message, such as numeric, alphanumeric, or digital voice messages. However, it will be appreciated that other well known selective call signaling formats, such as tone only signaling or tone and voice signaling, would be suitable for use as well. The transceiver 760 processes the RF signal and produces at the output a data stream representative of a demodulated data information. The demodulated data information is coupled into the input of a controller 762 which processes the information. A baud detector 774, coupled to the controller 762, is used to detect the baud rate of the received selective call signal. A power switch 766, coupled to the controller 762, is used to control the supply of power to the transceiver 760.

When the address is received by the controller 762, the received address is compared with one or more addresses stored in a code plug (or code memory) 772, and when a match is detected, an alert signal is generated to alert a user that a selective call message or page has been received. The alert signal is directed to an audible alerting device 768 for generating an audible alert, such as a tone or voice message, or to a tactile alerting device 770 for generating a silent vibrating alert. Switches 776 allow the user of the selective call transceiver to, among other things, select between the audible alert 768 and the tactile alert 770 in a manner well known in the art.

The message information which is subsequently received is stored in memory 304 (FIG. 8) and can be accessed by the user for display or, for example, digital voice messaging, using one or more of the switches 776 which provide such additional functions as reset, read, and delete, etc. Specifically, by the use of appropriate functions provided by the switches 776, the stored message is recovered from memory and processed by the controller 762 for displaying by a display 764 which enables the user to view the message or for the playing of a received digital voice message.

Upon proper receipt of a selective call transmission, the selective call transceiver 750 responds with an RF transmission back to the selective call terminal 754. In this respect, the transmitter portion of the transceiver 760 is modulated with digital data provided from the controller 762. The modulated RF is transmitted by another patch antenna system 101 constructed in accordance with the teachings of the present invention and is received by a receiving antenna 758 and a receiver 759. The receiver 759 is connected to the selective call terminal 754. The received data include, for example, information on the location of the selective call transceiver 750. If transmission and receipt of the RF signals between the selective call terminal 754 and the selective call transceiver 750 are at the same frequency, it is possible to use only a single antenna at each location instead of the dual antennas that are illustrated here.

Figure 8:
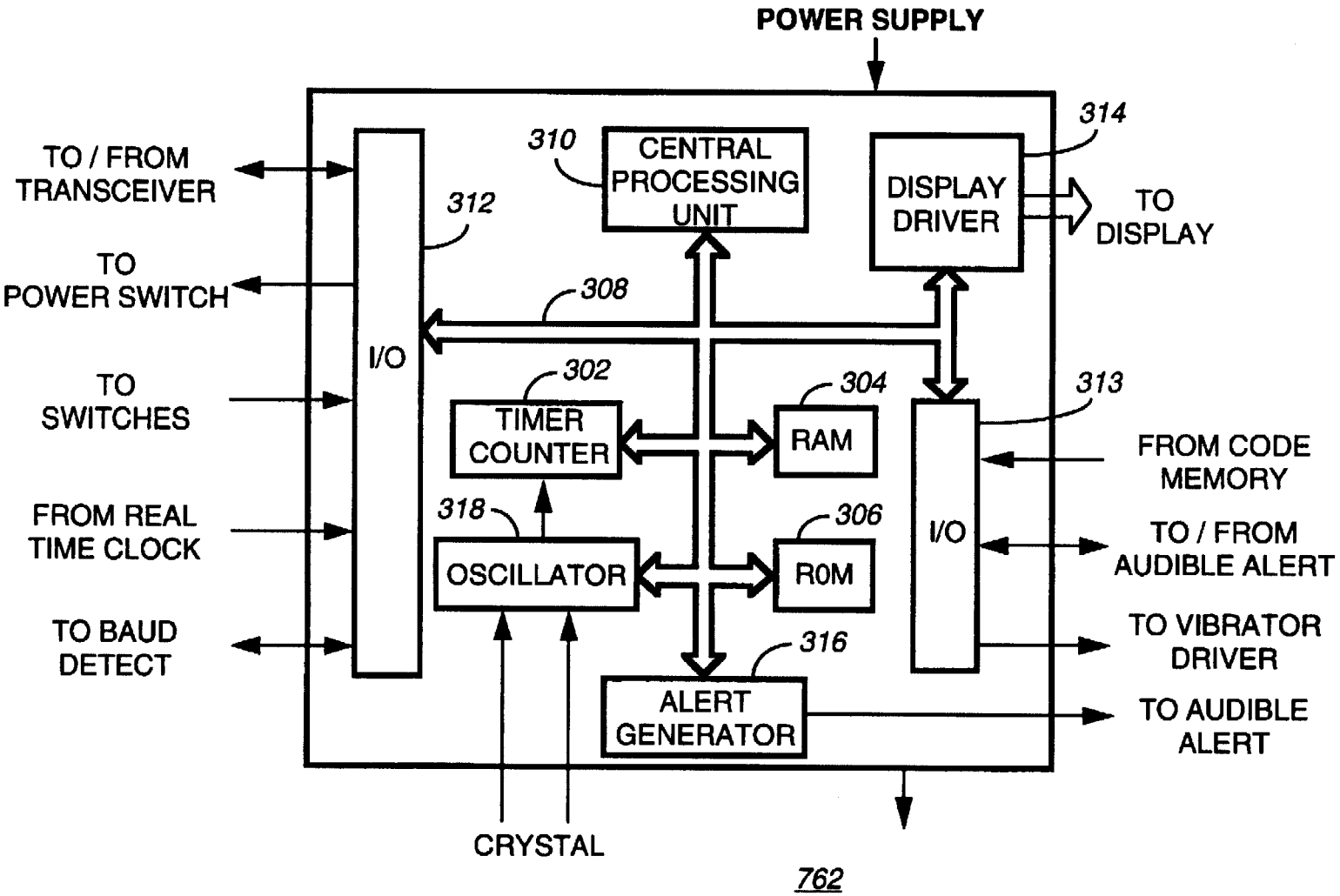
FIG. 8 is an electrical block diagram of the controller/decoder utilized in the system of FIG. 7.

FIG. 8 is an electrical block diagram of a microcomputer based decoder/controller suitable for use in the selective call receiver of FIG. 7. The controller 762 of FIG. 7 can be implemented utilizing a microcomputer as shown in FIG. 8 which, in turn, is interconnected by traces formed in metallization layers well known in the art. As shown, the controller 762 is preferably of the MC68HC05 series microcomputers, such as manufactured by Motorola, Inc., which includes an on-board display driver 314. The controller 762 includes an oscillator 318 which generates the timing signals utilized in the operation of the controller 762. A crystal, or crystal oscillator (not shown), is coupled to the inputs of the oscillator 318 to provide a reference signal for establishing the microcomputer timing. A timer/counter 302 couples to the oscillator 318 and provides programmable timing functions which are utilized in controlling the operation of the receiver or the processor. A RAM (random access memory) 304 is utilized to store variables derived during processing, as well as to provide storage of message information which is received during operation as a selective call receiver. A ROM (read only memory) 306 stores the subroutines which control the operation of the receiver or the processor which will be discussed further. It will be appreciated that, in many microcomputer implementations, the programmable-ROM (PROM) memory area can be provided either by a programmable read only memory (PROM) or an EEPROM (electrically erasable programmable read only memory). The oscillator 318, timer/counter 302, RAM 304, and ROM 306 are coupled through an address/data/control bus 308 to a central processing unit (CPU) 310 which performs the instructions and controls the operations of the controller 762.

The demodulated data generated by the receiver is coupled into the controller 762 through an input/output (I/O) port 312. The demodulated data is processed by the CPU 310, and when the received address is the same as stored within the code-plug memory which couples into the microcomputer, through, for example, an I/O port 313, the message, if any, is received and stored in RAM 304. Recovery of the stored message and selection of the predetermined destination address are provided by the switches which are coupled to the I/O port 312. The controller 762 then recovers the stored message and directs the information over the data bus 308 to the display driver 314 which processes the information and formats the information for presentation by a display 764, such as an LCD (liquid crystal display). If a digital voice message is received and stored, the data can be accessed by the audible alert 768 which, for example, include a digital voice synthesizer, through the I/O 313. At the time a selective call receiver's address is received, the alert signal is generated which can be routed through the data bus 308 to an alert generator 316 that generates the alert enable signal which is coupled to the audible alert device which also includes a tone generator. Alternatively, when the vibrator alert is selected, as described above, the controller generates an alert enable signal which is coupled through data bus 308 to the I/O port 313 to enable generation of a vibratory or silent alert.

In this way, a molded patch antenna is provided with co-axial connector integrated in the substrate and electrically coupled to the ground and the signal leads. Accordingly, the need for soldering the connector or a conductive interface to the antenna is eliminated thereby greatly reducing the opportunity for defects. Additionally, because the patch antenna and the connector can be assembled via a manufacturing process, the cost for manufacturing the patch antenna and embedded connector is greatly reduced.

In summary, a portable communication device comprises a receiver coupled to a molded patch antenna and decoder controller. The molded patch antenna comprises a signal lead (or terminal), a ground lead (or terminal), and a dielectric embedding the signal terminal and the ground terminal to form a connector substrate assembly having a predetermined impedance. A first conductive material is affixed to a first side of the connector substrate assembly coupling to the ground terminal and a second conductive material is affixed to a second opposite side of the connector substrate assembly coupling the signal terminal.

The present patch antenna system has been described in the context of a selective call transceiver. It will be recognized, however, that the presently disclosed antenna system can be used in other types of communications devices, including RF transmission devices, traditional selective call systems, etc.

Although the present invention has been described with reference to a specific embodiment, those of skill in the art will recognize that changes may be made thereto without departing from the scope and spirit of the invention as set forth in the appended claims.

Thus, what is claimed is:

1. A method for forming a molded patch antenna having an embedded connector, comprising the steps of:

(a) forming a connector by coupling a cylindrical housing terminating in a cylindrical ground lead with a circular signal lead;

(b) injecting dielectric insulating the cylindrical ground lead from the circular signal lead forming a connector substrate assembly having first side coupled with the cylindrical ground lead and a second opposite side for coupling with the circular signal lead;

(c) removing the connector substrate assembly from the mold;

(d) affixing a conductive material to the first side of the connector substrate assembly thereby coupling to the cylindrical ground lead; and (e) affixing another conductive material to the second opposite side of the connector substrate assembly thereby coupling to the circular signal lead.

2. A method forming a molded patch antenna having a connector being embedded therein, comprising the steps of:

(a) coupling a circular signal terminal with a cylindrical ground terminal in the mold;

(b) injecting dielectric for capturing and insulating the circular signal terminal centrally positioned within the cylindrical ground terminal of the connector to form a connector substrate assembly;

(c) affixing a conductive surface to a first side of the connector substrate assembly thereby coupling to the cylindrical ground terminal of the connector; and (d) affixing second conductive surface to an opposite side of the connector substrate assembly thereby coupling to the circular signal terminal of the connector.

3. The method according to claim 2 wherein the step (b) of injecting further comprising a step of obtaining a predetermined impedance.

4. The method according to claim 2 wherein the step (b) of injecting further comprising a step of forming a connector.

5. An antenna, comprising:

a connector having a cylindrical ground lead and a circular signal lead;

a dielectric capturing and embedding the circular signal lead centrally located within the cylindrical ground lead of the connector forming a connector substrate assembly having a first side and a second opposite side;

a first conductive surface affixed to the first side of the connector substrate assembly being electrically coupled to the cylindrical ground lead; and a second conductive surface affixed to the second opposite side of the connector substrate assembly being electrically coupled to the circular signal lead.

6. The antenna according to claim 5 wherein the connector comprises a coaxial connector.

7. The antenna according to claim 5 wherein the first and second conductive surfaces are copper.

8. The antenna according to claim 5 wherein the connector has a predetermined impedance.

9. An antenna, comprising:

a circular signal terminal;

a cylindrical ground terminal;

a dielectric embedding the circular signal terminal centrally located within the cylindrical ground terminal to form a connector substrate assembly having a predetermined impedance;

a copper surface affixed to a first side of the connector substrate assembly being coupled to the cylindrical ground terminal; and a copper surface affixed to a second opposite side of the connector substrate assembly coupled to the circular signal terminal.

10. A portable communication device comprising:

a receiver coupled to a molded patch antenna and decoder controller, the molded patch antenna comprising:

a circular signal terminal;

a cylindrical ground terminal;

a dielectric embedding the circular signal terminal centrally within the cylindrical ground terminal to form a connector substrate assembly having a predetermined impedance;

a first conductive surface affixed to a first side of the connector substrate assembly being coupled to the cylindrical ground terminal; and a second conductive surface affixed to a second opposite side of the connector substrate assembly coupled to the circular signal terminal.

11. The portable communication device according to claim 10 wherein the first and second conductive surfaces are copper.

12. A portable communication device comprising:

a receiver coupled to an antenna and a decoder/controller, the antenna comprising:

a connector having a cylindrical ground lead and a circular signal lead;

a dielectric capturing and embedding the circular signal lead centrally positioned within the cylindrical ground lead of the connector forming a connector substrate assembly having a first side and a second opposite side;

a first conductive surface affixed to the first side of the connector substrate assembly being coupled to the cylindrical ground lead; and a second conductive surface affixed to the second opposite side of the connector substrate assembly being coupled to the circular signal lead.

13. The portable communication device according to claim 12 wherein the first and second conductive surfaces are copper.

14. The portable communication device according to claim 12 wherein the connector has a predetermined impedance.

15. The portable communication device according to claim 12 wherein the connector comprises a co-axial connector.

* * * * *